US008471802B2

(12) United States Patent
Senda et al.

(10) Patent No.: US 8,471,802 B2
(45) Date of Patent: Jun. 25, 2013

(54) LIQUID CRYSTAL DISPLAY

(75) Inventors: Michiru Senda, Tokyo (JP); Ryoichi Yokoyama, Tokyo (JP)

(73) Assignee: Samsung Display Co., Ltd. (KR)

( * ) Notice: Subject to any disclaimer, the term of this patent is extended or adjusted under 35 U.S.C. 154(b) by 1575 days.

(21) Appl. No.: 11/929,346

(22) Filed: Oct. 30, 2007

(65) Prior Publication Data

US 2008/0198120 A1 Aug. 21, 2008

(30) Foreign Application Priority Data

Feb. 15, 2007 (KR) ..... 10-2007-0016086

(51) Int. Cl.
*G09G 3/36* (2006.01)

(52) U.S. Cl.
USPC ..... 345/98

(58) Field of Classification Search
USPC ..... 345/87–104, 204, 690
See application file for complete search history.

(56) References Cited

U.S. PATENT DOCUMENTS

| | | | | |
|---|---|---|---|---|
| 6,115,018 | A * | 9/2000 | Okumura et al. | 345/95 |
| 2002/0008685 | A1* | 1/2002 | Ban et al. | 345/92 |
| 2002/0084969 | A1* | 7/2002 | Ozawa | 345/96 |
| 2003/0006948 | A1* | 1/2003 | Son et al. | 345/87 |
| 2006/0132418 | A1* | 6/2006 | Morita | 345/98 |
| 2006/0227096 | A1* | 10/2006 | Fujita | 345/100 |
| 2007/0188431 | A1* | 8/2007 | Sato et al. | 345/90 |

FOREIGN PATENT DOCUMENTS

| | | | |
|---|---|---|---|
| JP | 01-231026 | | 9/1989 |
| JP | 2001-265287 | A | 9/2001 |
| JP | 2002-196358 | | 7/2002 |
| JP | 2002-303887 | A | 10/2002 |
| JP | 2002-350810 | A | 12/2002 |
| JP | 2003280600 | A | 10/2003 |
| JP | 2003-344823 | A | 12/2003 |
| JP | 2006-145923 | | 6/2006 |
| JP | 2007-010945 | A | 1/2007 |
| JP | 2008-026817 | A | 2/2008 |

* cited by examiner

*Primary Examiner* — Sumati Lefkowitz
*Assistant Examiner* — Robert E Carter, III
(74) *Attorney, Agent, or Firm* — Innovation Counsel LLP

(57) ABSTRACT

A small or middle-sized liquid crystal display employing a black insertion driving method overcomes the after-image or blurring of a moving picture by shifting the level of a voltage applied to a storage capacitor line within a predetermined period corresponding to about 20% to about 80% that lasts after image signals are applied to pixels until the next image signals are applied to the pixels by using two types of voltages that shift pixel voltages into a black display potential.

16 Claims, 9 Drawing Sheets

LIQUID CRYSTAL DISPLAY

CROSS-REFERENCE TO RELATED APPLICATION

This application relies for priority upon Korean Patent Application No. 2007-16086 filed on Feb. 15, 2007, the contents of which are herein incorporated by reference in its entirety.

BACKGROUND OF THE INVENTION

1. Field of the Invention

The present invention relates to a liquid crystal display employing a black insertion driving method.

2. Description of the Related Art

The low response speed of conventional active matrix-type liquid crystal displays employing the hold driving method results in undesirable after-images or blurring when a moving picture is displayed. To improve the response speed, large liquid crystal displays for television receivers compare the image signal of a previous frame with the image signal of the present frame and provide an overdrive voltage that overlaps the image signal according to the comparison result. However, this procedure is inapplicable to small liquid crystal displays having a limited number of circuits and requiring low power consumption.

In order to solve the problems of the hold driving method for liquid crystal, an impulsive driving method has been suggested. The impulsive driving method includes black insertion driving in which a first image is displayed on the screen using normal image signals and then a second image is displayed using black image signals so that the normal image signals and the black image signals are alternately displayed on the screen.

According to another example of the impulsive driving method, a backlight is shut-off during a predetermined period corresponding to 40% of a frame period. However, if the backlight is shut off over the whole area of the screen, the upper screen and lower portions of the screen appear differently.

Although various techniques have been proposed to improve the response speed and the hold driving method of liquid crystal, such techniques are unsuitable for small-sized or middle-sized liquid crystal displays having a small number of circuits and requiring low power consumption. For example, since a large-sized liquid crystal television set uses many cold cathode fluorescent lamps (CCFL) or light emitting diodes (LEDs) as a backlight unit, the backlight scanning method is suitable. However, since the small-sized or middle-sized liquid crystal displays employs one or two CCFLs and one to three LEDs, the backlight scanning method is not as suitable.

In the black insertion driving method because image signals are written twice within one frame period the driving frequency becomes high, so that power consumption is increased. For this reason, the black insertion driving method is rarely employed in the small-sized or middle-sized liquid crystal display having a small number of circuits and requiring low power consumption.

SUMMARY OF THE INVENTION

The present invention, according to one aspect thereof, provides a liquid crystal display employing a black insertion driving scheme adaptable for a small-sized or middle-sized liquid crystal display that overcomes after-images and blurring of moving pictures.

In another aspect of the present invention, a liquid crystal display includes a plurality of pixels, a plurality of gate lines, a plurality of storage capacitor lines, a gate driver, and a storage capacitor driver. The pixels include thin film transistors and storage capacitors. The gate lines are connected to gates of the thin film transistors of the pixels. The storage capacitor lines are connected to first end portions of the pixels' storage capacitors. The gate driver drives the gate lines within a frame period. The storage capacitor driver changes voltages applied to the storage capacitor lines within the frame period, thereby shifting pixel voltages applied to the pixels into a black display potential.

The storage capacitor driver changes the levels of the voltages applied to the storage capacitor lines within a first predetermined period corresponding to 20% to 80% of a second predetermined period, which lasts after image signals are applied to the pixels until the next image signals are applied to the pixels and shifts the voltages applied to the pixels into the black display potential.

The first predetermined period, which lasts until the levels of the voltages applied to the storage capacitor lines are changed to the second levels, represents an image display period. The third predetermined period, which lasts until the next image signals are applied to the pixels after the levels of the voltages applied to the storage capacitor lines are changed into the second levels, represents a black display period. In contrast, the first predetermined period, which lasts until the levels of the voltages applied to the storage capacitor lines are changed to the second levels from the first levels after the image signals are applied to the pixels, represents a black display period, and a third predetermined period, which lasts until the next image signals are applied to the pixels after the levels of the voltages applied to the storage capacitor lines are changed into the second levels, represents an image display period.

The storage capacitor driver drives the storage capacitor lines in the same direction as the direction in which the gate lines are driven by the gate driver.

The liquid crystal display further includes a common electrode disposed in opposition to the pixels, and a common electrode voltage generator supplying a DC voltage to the common electrode within a frame period.

In another aspect of the present invention, a liquid crystal display includes a plurality of pixels, a plurality of gate lines, a plurality of storage capacitor lines, a gate driver, and a storage capacitor driver. The pixels are arranged in a predetermined direction, and include thin film transistors and storage capacitors. The gate lines are connected to gates of the thin film transistors of the pixels. The storage capacitor lines are connected to first end portions of the storage capacitors of the pixels. The gate driver drives the gate lines within one frame period. The storage capacitor driver changes levels of voltages applied to the storage capacitor lines into first levels within one frame period to shift pixel voltages applied to the pixels into an image display potential different from the pixel voltages, and then changing the levels of the voltages applied to the storage capacitor lines into second levels or third levels to shift pixel voltages applied to the pixels into a black display potential.

The storage capacitor driver changes levels of the voltages applied to the storage capacitor lines to second levels or third levels from first levels within a period, which lasts until the next image signals are applied to the pixels In addition, the storage capacitor driver changes levels of the voltages applied to the storage capacitor lines to second levels or third levels from first levels within a first predetermined period corresponding to about 20% and about 80% of a second predetermined period, which lasts until the next image signals are applied to the pixels. The predetermined period, which lasts until the levels of the voltages applied to the storage capacitor lines are changed to the second levels or the third levels from the first levels after the image signals are applied to the pixels, represents an image display period, and a third predetermined period, which lasts until the next image signals are applied to the pixels after the levels of the voltages applied to the storage capacitor lines are changed into the second levels or the third levels, represents a black display period. In contrast, the first predetermined period, which lasts until the levels of the voltages applied to the storage capacitor lines are changed to the second levels or the third levels from the first levels after the image signals are applied to the pixels, represents a black display period, and a third predetermined period, which lasts until the next image signals are applied to the pixels after the levels of the voltages applied to the storage capacitor lines are changed into the second levels or the third levels, represents an image display period.

In another aspect of the present invention, a liquid crystal display includes a plurality of pixels, a plurality of gate lines, a plurality of storage capacitor lines, a timing controller, a voltage generator, a gate driver, a storage capacitor driver, a common electrode, and a common electrode generator. The pixels are arranged in a predetermined direction, and include thin film transistors and storage capacitors. The gate lines connect to gates of the thin film transistors. The storage capacitor lines are connected to first end portions of the storage capacitors of the pixels. The timing controller outputs a clock signal, an image signal, and control signals. The voltage generator outputs a gate voltage signal, a common voltage signal, and a plurality of storage capacitor voltage signals in response to the control signal from the timing controller. The gate driver drives the gate lines within one frame period in response to the clock signal from the timing controller and the gate voltage signal from the voltage generator. The storage capacitor driver receives the storage capacitor voltage signals, and changes the voltages applied to the storage capacitor lines within a frame period in response to the clock signal and the control signal from the timing controller, so that pixel voltages applied to the pixels are shifted into a black display potential. The common electrode is disposed in opposition to the pixels. The common electrode voltage generator supplies a DC voltage to the common electrode within a frame period.

BRIEF DESCRIPTION OF THE DRAWINGS

The above and other advantages of the present invention will become readily apparent by reference to the following detailed description when considered in conjunction with the accompanying drawings, in which.

DESCRIPTION OF THE EMBODIMENTS

Embodiment 1

Hereinafter, a liquid crystal display 1 according to a first embodiment of the present invention will be described in detail with reference to accompanying drawings.

Figure 1:
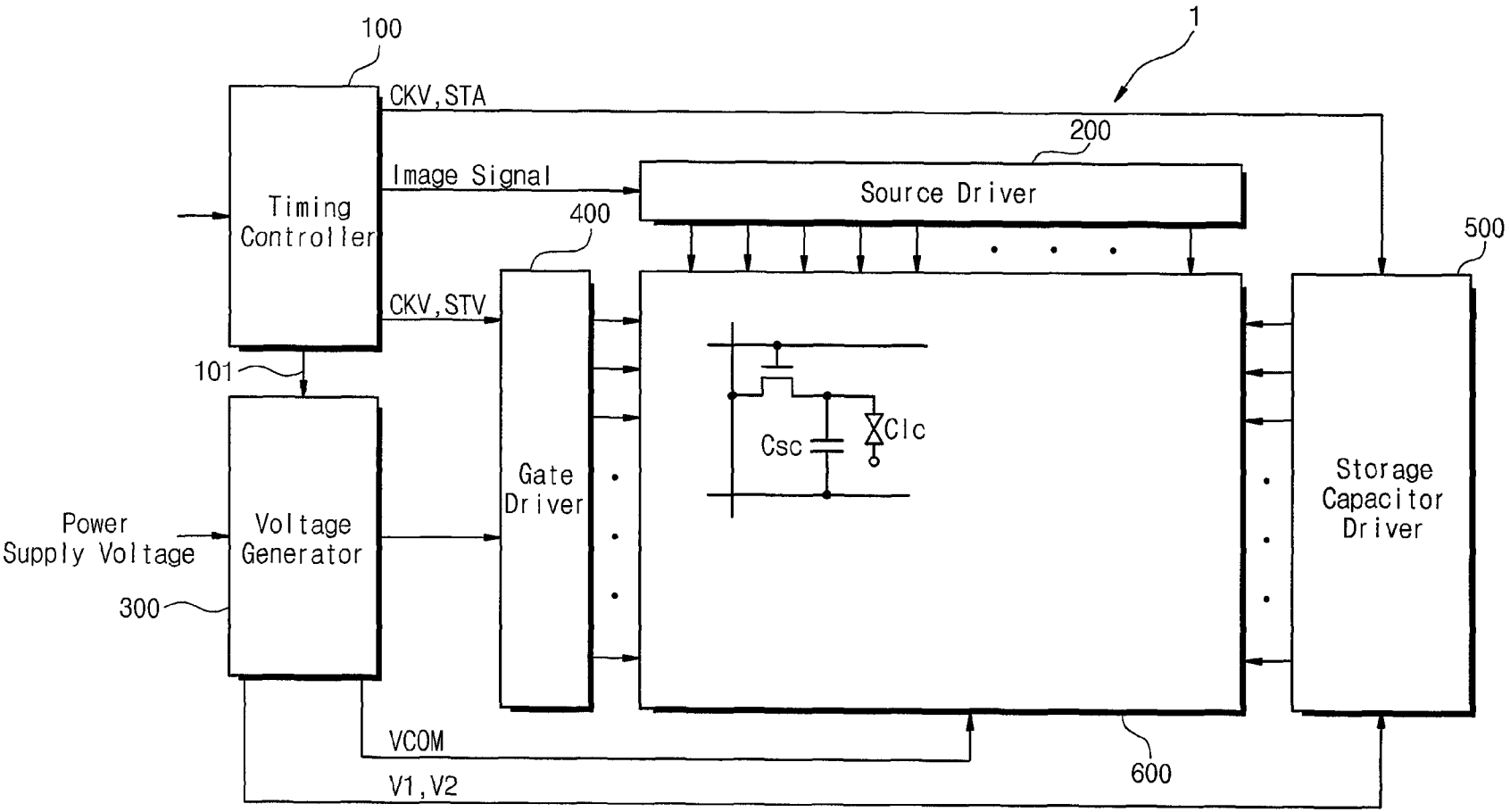
FIG. 1 is a block diagram showing a liquid crystal display according to a first embodiment of the present invention.

FIG. 1 is a block diagram showing the liquid crystal display 1. As shown in FIG. 1, the liquid crystal display 1 includes a timing controller 100, a source driver 200, a voltage generator 300, a gate driver 400, a storage capacitor driver 500, and an LCD panel 600. The liquid crystal display 1 is a small or middle-sized LCD module that can be used for electronic appliances, such as a cellular phone terminal and a personal computer.

The timing controller 100 controls the operations of the source driver 200, the voltage generator 300, the gate driver 400, and the storage capacitor driver 500 in the liquid crystal display 1.

The source driver 200 outputs image voltages, which are applied to liquid crystal capacitors Clc, to source lines in the LCD panel 600 by image signals input from the timing controller 100.

The voltage generator 300 generates a first gate driving voltage in response to a power supply voltage input from an exterior and outputs the first gate driving voltage to the gate driver 400. In addition, the voltage generator 300 generates a common electrode voltage VCOM to output the common electrode voltage VCOM to the LCD panel 600, and generates first and second storage capacitor driving voltages V1 and V2 having different voltage levels to output the first and second storage capacitor driving voltages V1 and V2 to the storage capacitor driver 500. In the present exemplary embodiment, the first storage capacitor driving voltage V1 has a level smaller than that of the second storage capacitor driving voltage V2.

The gate driver 400 generates a second gate driving voltage based on a clock signal CKV and a gate start signal STV, which are input from the timing controller 100, and the first gate driving voltage, which is input from the voltage generator 300, and then outputs the second driving voltage to each gate line of the LCD panel 600.

The storage capacitor driver 500 selects one of the first and second storage capacitor driving voltages V1 and V2 input from the voltage generator 300 to generate a storage capacitor driving signal and output the storage capacitor driving signal to each storage capacitor line in the LCD panel 600, based on the clock signal CKV and a control signal (hereinafter, referred to as "an STA signal"), which are input from the timing controller 100.

The LCD panel 600 includes a plurality of gate lines, which extend horizontally and are vertically arranged, a plurality of source lines, which extend vertically while crossing the gate lines and are horizontally arranged, a plurality of common electrode lines, switching elements (thin film transistors; TFT), which are connected to the gate lines and the source lines, a liquid crystal capacitor Clc, and a storage capacitor Csc having a second end terminal connected to the storage capacitor line. FIG. 1 shows the switching element, the liquid crystal capacitor Clc, and the storage capacitor Csc corresponding to only one pixel, and other elements having the structure are not shown. The LCD panel 600 displays an image voltage input from the source driver 200, in response to the second gate driving voltage (or a scan signal) input from the gate driver 400, the common electrode voltage VCOM input from the voltage generator 300, and the storage capacitor driving signal input from the storage capacitor driver 500.

Gate, source, and drain terminals of the TFT, which is provided at an area surrounded by the gate line and the source line, are connected to the gate line, the source line, and the liquid crystal capacitor Clc and the storage capacitor Csc, respectively, such that the TFT is turned on/off according to the scan signal input from the gate line.

The liquid crystal capacitor Clc controls the transmittance of light received from a backlight unit (not shown) in proportion to the image voltage input from the source driver 200 and the storage capacitor driving voltage input to the storage capacitor line from the storage capacitor driver 500 when the TFT is turned on. At this time, the storage capacitor Csc is charged with a pixel display voltage based on the potential difference between the image voltage input from the source driver 200 and the storage capacitor driving voltage input to the storage capacitor line from the storage capacitor driver 500 when the TFT is turned on, to apply the potential difference to the liquid crystal capacitor Clc.

Figure 2:
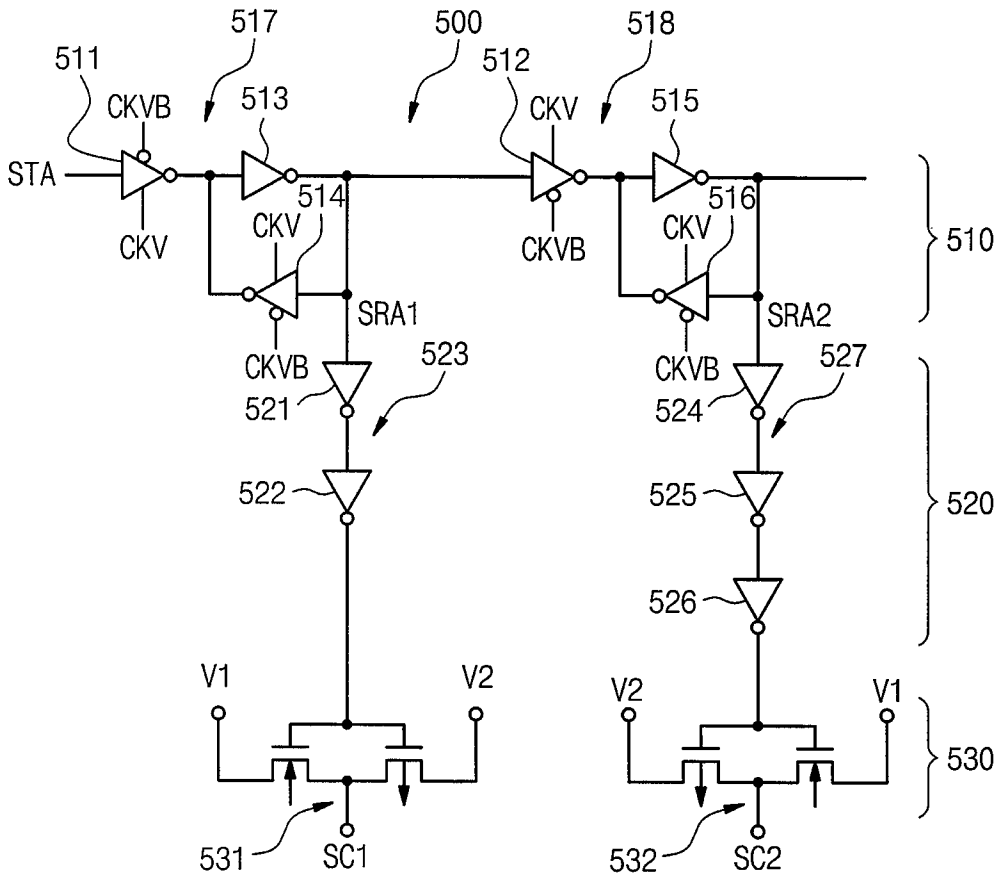
FIG. 2 is a circuit diagram showing a storage capacitor driver of FIG. 1.

Hereinafter, the circuit structure of the storage capacitor driver 500 will be described with reference to FIG. 2. As shown in FIG. 2, the storage capacitor driver 500 includes a shift register 510, a buffer 520, and a voltage level selector 530. In FIG. 2, only the circuit structure corresponding to first and second storage capacitor lines SC1 and SC2 of the LCD panel 600 is shown. Although not shown in the drawings, the same circuit structure is applicable for other storage capacitor lines SC3, and SCn.

The shift register 510 operates based on the clock signal CKV and the STA signal, which are input from the timing controller 100. The shift register 510 has a first flip-flop 517, which includes clock inverters 511 and 514 and an inverter 513, and a second flip-flop 518, which includes clock inverters 512 and 516 and an inverter 515. The first and second flip-flops 517 and 518 correspond to the first and second storage capacitor lines SC1 and SC2 in the LCD panel 600, respectively.

After latching the STA signal input from the timing controller 100 during a predetermined time interval based on the clock signal CKV and an inverted clock signal CKVB obtained by inverting the clock signal CKV, the first flip-flop 517 outputs a first output signal (hereinafter, referred to as "an SRA 1 signal") to the second flip-flop 518 and the buffer 520.

After latching the SRA1 signal input from the flip-flop 517 during a predetermined time interval based on the clock signal CKV and the inverted clock signal CKVB, the second flip-flop 518 outputs a second output signal (hereinafter, referred to as "an SRA2 signal") to a flip-flop (not shown) provided at a next stage of the second flip-flop 518, and the buffer 520.

The shift register 510 generates the SRA1 and SRA2 signals based on the STA signal input from the timing controller 100 to sequentially output the SRA1 and SRA2 signals to the buffer 520, through the operations of the first and second flip-flops 517 and 518.

The buffer 520 includes a first buffer 523, which is connected to an output terminal of the first flip-flop 517, and a second buffer 527, which is connected to an output terminal of the second flip-flop 518. The first buffer 523 includes inverters 521 and 522 corresponding to the first storage capacitor line SC1, and the second buffer 518 includes inverters 524, 525 and 526 corresponding to the second storage capacitor line SC2.

The first buffer 523 controls timing of selecting the first and second storage capacitor driving voltages V1 and V2 in the voltage level selector 530 according to the SRA1 signal input from the first flip-flop 517. The second buffer 527 controls timing of selecting the first and second storage capacitor driving voltages V1 and V2 in the voltage level selector 530 according to the signal SRA2 input from the second flip-flop 518.

The voltage level selector 530 includes an inverter 531, which is connected to an output terminal of the first buffer 523 and corresponds to the first storage capacitor line SC1, and an inverter 532, which is connected to an output terminal of the second buffer 527 and corresponds to the second storage capacitor line SC2.

The inverter 531 selects one of the first and second storage capacitor driving voltages V1 and V2 input from the voltage generator 300 to apply the selected storage capacitor driving voltage to the first storage capacitor line SC, according to the timing of selecting one of the first and second storage capacitor driving voltages V1 and V2 controlled by the first buffer 523.

The inverter 532 selects one of the first and second storage capacitor driving voltages V1 and V2 input from the voltage generator 300 to apply the selected storage capacitor driving voltage to the second storage capacitor line SC2, according to the timing of selecting one of the first and second storage capacitor driving voltages V1 and V2 controlled by the second buffer 527.

Hereinafter, the operation of the liquid crystal display 1 according to the first embodiment of the present invention will be described with reference to a timing chart shown in FIG. 3.

Figure 3:
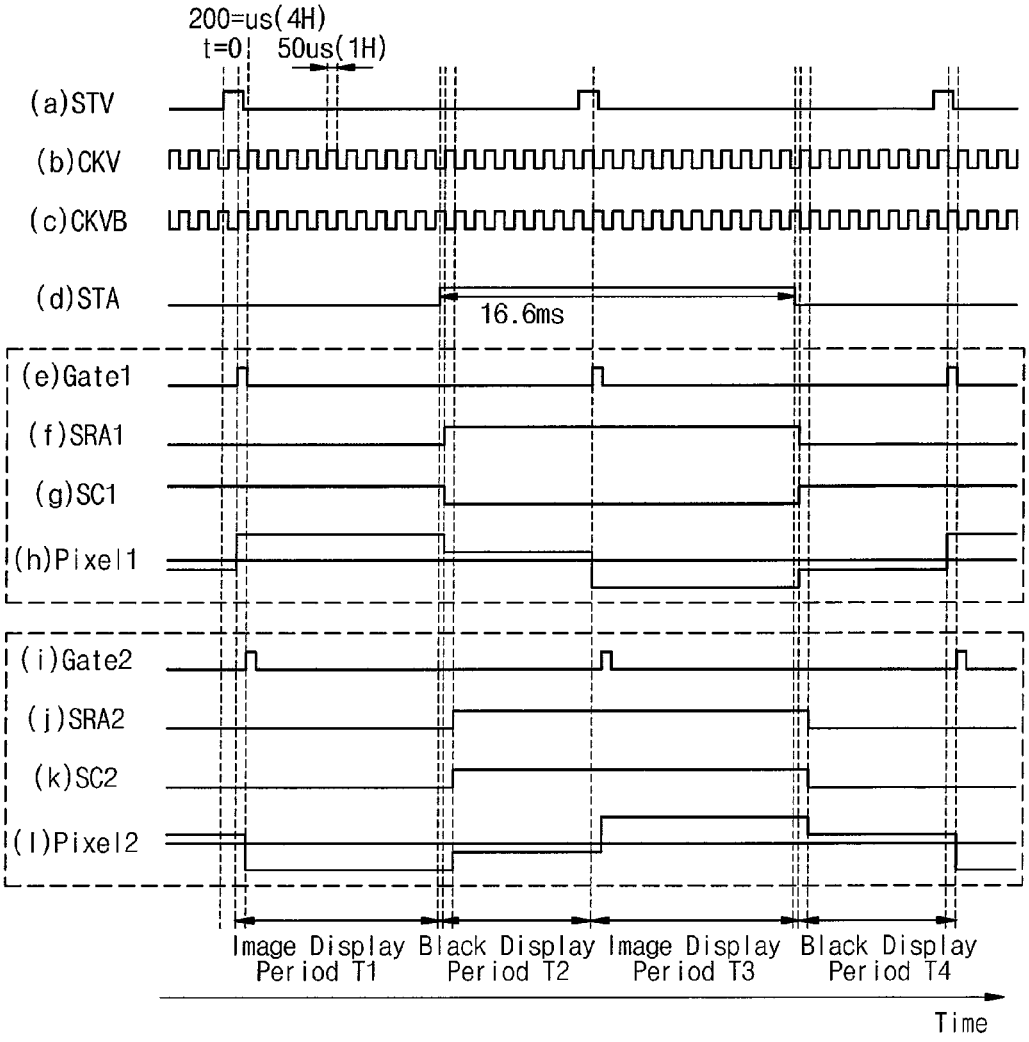
FIG. 3 is a timing diagram showing various signals employed for the liquid crystal display of FIG. 1.

FIGS. 3A and 3B represent the gate start signal STV input to the gate driver 400, and the clock signal CKV input to the gate driver 400 and the storage capacitor driver 500. FIGS. 3D to 3F represent the STA signal input to the storage capacitor driver 500, a scan signal Gate1 output to the first gate line from the gate driver 400, and the SRA1 signal generated from the storage capacitor driver 500, respectively. FIGS. 3G to 31 represent a voltage applied to the first storage capacitor line SC1 by the storage capacitor driver 500, a pixel voltage Pixel1 applied to a first pixel in the LCD panel 600, and a scan signal Gate2 output to the second gate line from the gate driver 400, respectively. FIGS. 3J to 3L represent the SRA2 signal generated from the storage capacitor driver 500, a voltage applied to the second storage capacitor line SC2 by the storage capacitor driver 500, and a pixel voltage Pixel2 applied to a second pixel in the LCD panel 600, respectively.

As shown in FIG. 3A, the gate start signal STV is output from the timing controller 100 with a predetermined time interval of about 16.6 ms. In other words, a second pulse of the gate start signal STV starts after the time interval of 16.6 ms lapses from starting timing (t=0) of an initial pulse of the gate start signal STV in FIG. 3A.

As shown in FIG. 3B, one pulse width of the clock signal CKV corresponds to one horizontal scanning period of 50 μs (1H=50 μs). The STA signal in FIG. 3D is used to control the operation of the storage capacitor driver 500.

The scan signal Gate1 in FIG. 3E is output to the first gate line from the gate driver 400 according to the gate start signal STV. The SRA1 signal in FIG. 3F is used to set timing of selecting one of the first and second storage capacitor driving voltages V1 and V2 applied to the first storage capacitor line SC1 according to the STA signal. FIG. 3G shows the variation of the first or second storage capacitor driving voltage V1 or V2 applied to the first storage capacitor line SC1 through timing set by the SRA1 signal. FIG. 3H shows the variation of the pixel voltage Pixel1 applied to the first pixel in the LCD panel 600.

The scan signal Gate2 in FIG. 3I is output to the second gate line from the gate driver 400 according to the gate start signal STV. The SRA2 signal in FIG. 3J is used to set timing of selecting one of the first and second storage capacitor driving voltages V1 and V2 applied to the second storage capacitor line SC2 according to the STA signal. FIG. 3K shows the variation of the first or second storage capacitor driving voltage V1 or V2 applied to the second storage capacitor line SC2 in timing set by the SRA2 signal. FIG. 3L shows the variation of the pixel voltage Pixel2 applied to the second pixel in the LCD panel 600.

The SRA1 and SRA2 signals are used to change the voltage applied to the storage capacitor line into the first storage capacitor driving voltage V1 or the second storage capacitor driving voltage V2 within a predetermined period corresponding to about 20% and about 80% of the period, which is lasted until the next image signals are applied to the first and second pixels after image signals are applied thereto, thereby shifting a pixel voltage into a black display potential.

FIGS. 3H and 3L represent the pixel voltages Pixel1 and Pixel2 applied to the first and second pixels in the LCD panel 600. In addition, both FIGS. 3H and 3L represent the common electrode voltage VCOM, and the level of the common electrode voltage VCOM is constant.

Figure 4:
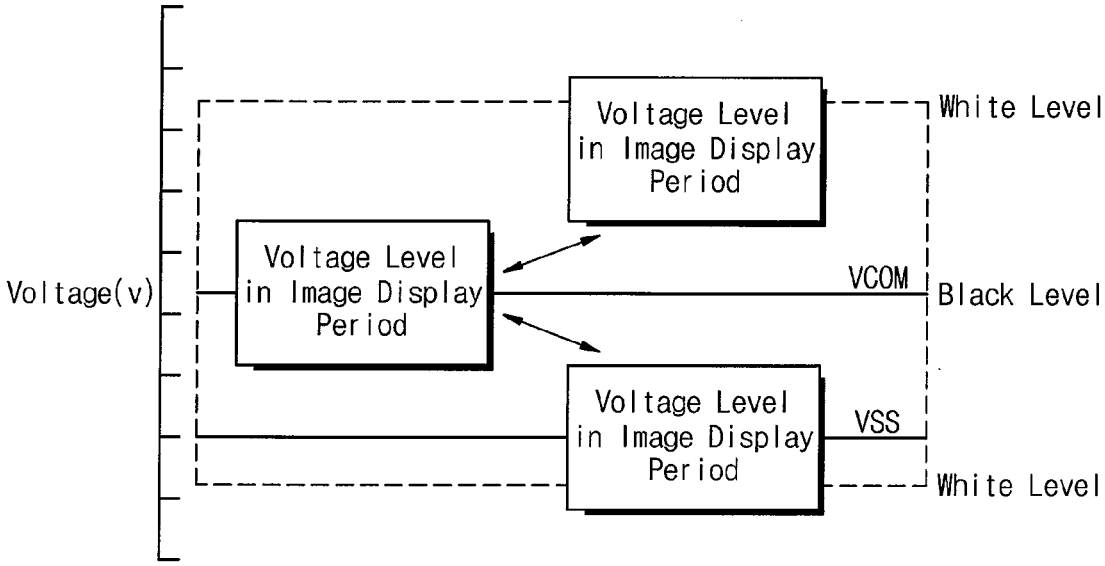
FIG. 4 is a view showing a relationship between a pixel voltage level in an image display period and a pixel voltage level in a black display period in the liquid crystal display of FIG. 1.

Then, FIG. 4 shows the relationship between pixel voltage levels in an image display period and a black display period set according to the variation of the voltage applied to the storage capacitor line. The change of the pixel voltage levels in the image display period and the black display period shown in FIG. 4 is achieved by shifting the voltage applied to the storage capacitor line. The first exemplary embodiment of the present invention is relative to a normally black LCD panel. However, when the first exemplar embodiment of the present invention is employed for the normally white LCD panel, the polarity of the pixel voltage is preferably inverted.

In this case, since the pixel voltages Pixel1 and Pixel2 are shifted through the capacity coupling of storage capacitors Csc, power consumption may be reduced compared to that of the conventional overdrive technique or the conventional impulsive type driving technique. In addition, since the insertion of a large capacity black image signal into the source line is unnecessary, power consumption may be reduced in the source driver. When a black display is dictated by a black image signal, the gate driver is subject to a scanning operation twice within one frame period, causing the driving frequency of the source driver or the gate driver to increase. However, in the driving method of the first embodiment of the present invention, since the pixel voltages are shifted using the capacity coupling of the storage capacitors Csc, the driving frequency of the source driver or the gate driver is not necessary to be increased. Therefore, a frame memory may be removed, and a manufacturing cost for the liquid crystal display may be reduced.

Figure 5:
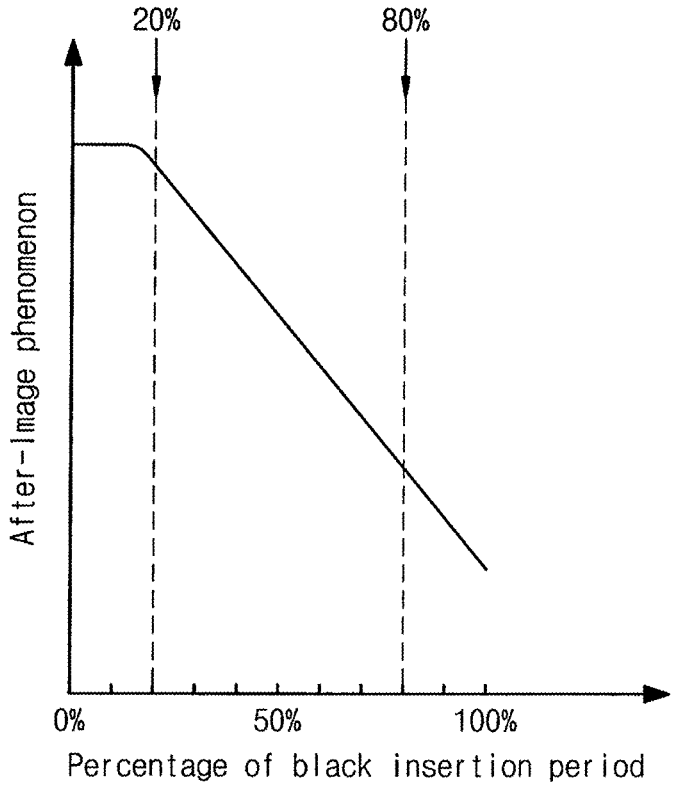
FIG. 5 is a graph showing a relationship between an after-image phenomenon and a black insertion period in the liquid crystal display of FIG. 1.

Hereinafter, details will be described with reference to FIG. 5 relative to the percentage of a black insertion period according to the first embodiment of the present invention. FIG. 5 is a graph showing a relationship between an after-image phenomenon and the percentage of the black insertion period. As shown in FIG. 5, the after-image phenomenon is reduced as the percentage of the black insertion period increases. The dot lines shown in FIG. 5 represent that the black display period is set within the range of about 20% and about 80% of one frame period according to the first embodiment of the present invention.

The black display period is set in the range of about 20% and about 80% of one frame period according to the first embodiment of the present invention, and the reason thereof will be described below with reference to FIG. 5. In FIG. 5, a vertical axis represents an after-image phenomenon, and a horizontal axis represents the percentage of the black insertion period in one frame period. The time required for the high-speed response of liquid crystal under development is about 4 ms, and this 4 ms corresponds to about 24% of 16.6 ms, which is one frame period. As shown in FIG. 5, when the black insertion period corresponds to about 80% of one frame period, power is consumed by five times of power consumed when the black insertion is not performed. Accordingly, preferably, the maximum percentage of the black insertion period is about 80% of one frame period. In addition, since the black insertion period, in which the reduction of the after-image phenomenon may be recognized, corresponds to about 20% or more of one frame period, the minimum black insertion period preferably corresponds to 20% of one frame period.

Hereinafter, the operation of the liquid crystal display 1 according to the first exemplary embodiment of the present invention will be described in detail with reference to the timing chart shown in FIG. 3.

When the liquid crystal display 1 is powered on, the timing controller 100 inputs the clock signal CKV and the gate start signal STV shown in FIGS. 3A and 3B to the gate driver 400. In addition, the timing controller 100 inputs the clock signal CKV and the STA signal shown in FIGS. 3A and 3B to the storage capacitor driver 500.

If the clock signal CKV and the gate start signal STV are input to the gate driver 400, the scan signals Gate1 and Gate2 are sequentially output to the first and second gate lines according to the gate start signal STV as shown in FIGS. 3E and 31. The source driver 200 sequentially outputs image voltages Pixel1 and Pixel2 according to image signals input from the timing controller 100 to source lines in the LCD panel 600. The pixel voltages Pixel1 and Pixel2 according to the image signals are applied to the first and second pixels in an image display period T1 shown in FIGS. 3H and 3L, through the operations of the gate driver 400 and the source driver 200.

Subsequently, upon receiving the clock signal CKV and the STA signal, the storage capacitor driver 700 selects the first storage capacitor driving voltage V1 by the signal SRA1 to apply the first storage capacitor driving voltage V1 to the first storage capacity line SC1, and selects the second storage capacitor driving voltage V2 by the signal SRA2 to apply the second storage capacitor driving voltage V2 to the second storage capacitor line SC2, in a low level of the STA signal as shown in FIGS. 3F and 3J.

Then, the storage capacitor driver 700 selects the second storage capacitor driving voltage V2 by the signal SRA1 to apply the second storage capacitor driving voltage V2 to the first storage capacitor line SC1, and selects the first storage capacitor driving voltage V1 by the signal SRA2 to the first storage capacitor driving voltage V1 to the second storage capacitor line SC2, in the high level of the STA signal. Accordingly, the pixel voltages Pixel1 and Pixel2 are shifted into the black display potential (VCOM) in the black display period T2 shown in FIGS. 3H and 3L.

Thereafter, in FIG. 3D, the STA signal maintains a high level even after the second pulse of the gate start signal STV starts, and an image display of the second image display period T3 starts during the high level period of the STA signal. Since the LCD panel 600 employs the alternating current driving mode, in which the polarity of an image signal is inverted in each frame, an image signal obtained by inverting the polarity of the image signal in the first image display period T1 is output from the source driver 200 in the second image display period T3.

In the image display period T3, the second storage capacitor driving voltage V2 is selected by the signal SRA1 and applied to the first storage capacitor line SC1, and the first storage capacitor driving voltage V1 is selected by the second signal SRA2 and applied to the second storage capacitor line SC2. For this reason, the pixel voltages Pixel1 and Pixel2 according to the image signals are applied to the first and second pixels in the image display period T3.

If the level of the STA signal is changed into a low level in FIG. 3D, the first storage capacitor driving voltage V1 is selected by the signal SRA1 and applied to the first storage capacitor line SC1, and the second storage capacitor driving voltage V2 is selected by the signal SRA2 and applied to the second storage capacitor line SC2. Accordingly, the pixel voltages Pixel1 and Pixel2 are shifted into the black display potential (VCOM) in the black display period T4 shown in FIGS. 3H and 3L.

Then, the above operations are sequentially repeated. The operations for two gate lines and two storage capacitor lines shown in FIG. 3 are also adopted for other gate lines and other storage capacitor lines not shown. As shown in FIGS. 3H and 3L, the black display period corresponds to about 40% of the period that persists until the next image signals are applied to the first and second pixels.

As described above, in the liquid crystal display 1 according to the first embodiment of the present invention, the storage capacitor driver 500 shifts the level of the voltage that is applied to the storage capacitor within a predetermined period corresponding to about 20% to about 80% of the period, which is lasted until the next image signals are applied to the first and second pixels after image signals are applied thereto, by using the first and second storage capacitor driving voltages V1 and V2 having different voltage levels, thereby shifting the pixel voltages Pixel1 and Pixel2 into the black display potential.

Accordingly, the conventional black insertion technique for a large-sized TFT liquid crystal display panel may be adopted for small-sized or middle-sized TFT liquid crystal display panels without increasing the costs of the TFT liquid crystal display panels, so that an after-image phenomenon may be reduced when a moving picture is displayed, and the costs of liquid crystal displays may be reduced. Further, in the liquid crystal display 1 according to the first embodiment of the present invention, since image voltages according to image signals are applied to pixels in the image display period, and the image voltage is shifted into the black display potential by the voltage applied to the storage capacitor line in the black display period, a gamma characteristic may be easily set.

In addition, according to the first exemplary embodiment of the present invention, although the black display period is set at about 40% of the period which is lasted until the next image signals are applied to the first and second pixels after image signals are applied thereto, the percentage of the black display period may be changed in the range of about 20% to about 80% of the period which is lasted until the next image signals are applied to the first and second pixels after image signals are applied thereto.

Embodiment 2

Black insertion driving is performed by using first and second storage capacitor driving voltages V1 and V2 having different voltage levels according to the first exemplary embodiment of the present invention. In the second exemplary embodiment of the present invention, the black insertion driving is performed by using first to third storage capacitor driving voltages V1, V2 and V3 having different voltage levels.

Figure 6:
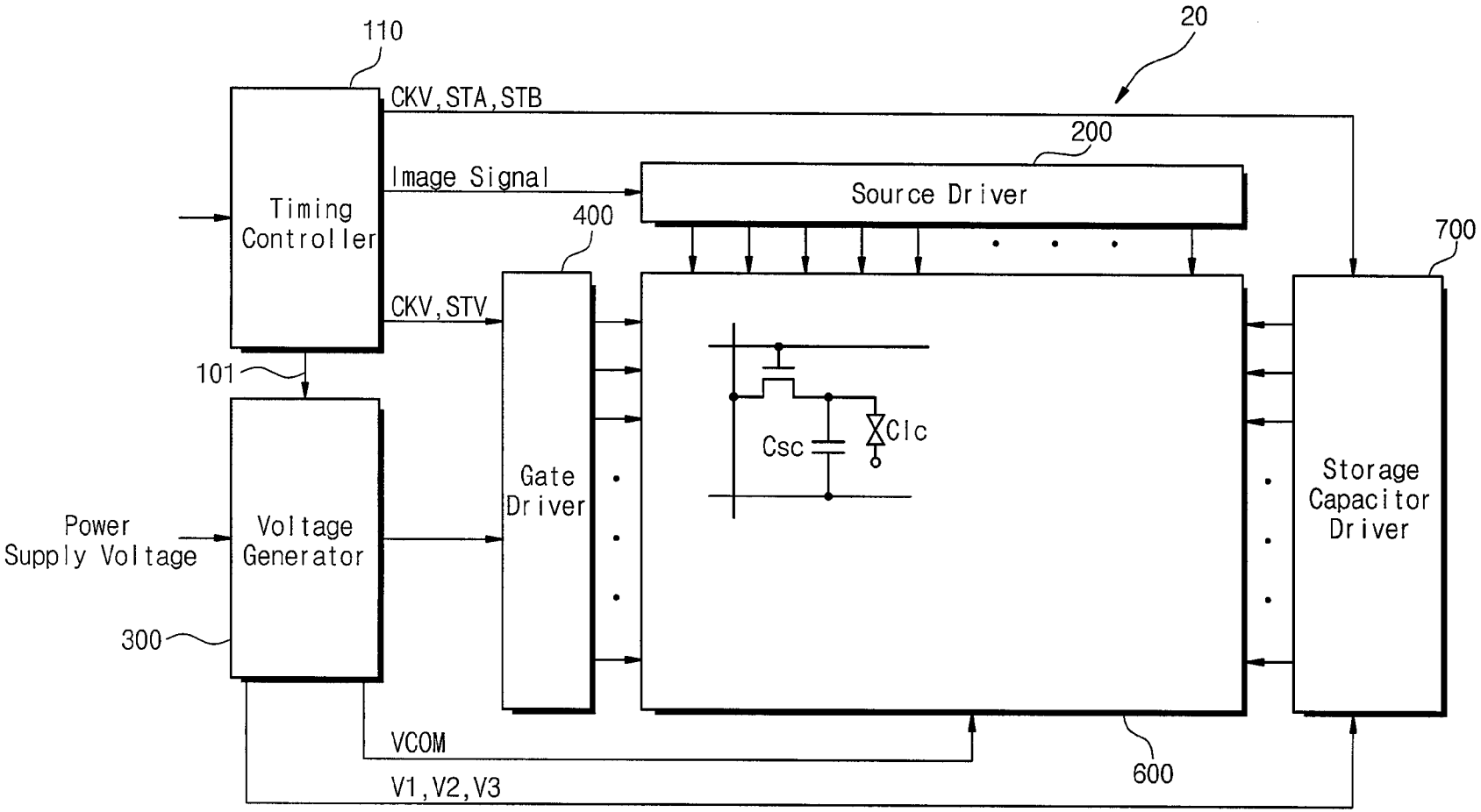
FIG. 6 is a block diagram showing a liquid crystal display according to a second embodiment of the present invention.

FIG. 6 is a block diagram showing a liquid crystal display 20 according to the second exemplary embodiment of the present invention. The same reference numeral will be assigned to the elements identical to those shown in FIG. 1, and details of the elements will be omitted in order to avoid redundancy. As shown in FIG. 6, the liquid crystal display 20 includes a timing controller 110, a source driver 200, a voltage generator 300, a gate driver 400, a storage capacitor driver 700, and an LCD panel 600. The liquid crystal display 20 according to the second exemplary embodiment of the present invention is a small-sized or middle-sized LCD module that can be used for electronic appliances, such as a cellular phone terminal and a personal computer.

The timing controller 110 controls the operations of the source driver 200, the voltage generator 300, the gate driver 400, and the storage capacitor driver 700 in the liquid crystal display 20.

The storage capacitor driver 700 selects one of the first to third storage capacitor driving voltages V1 to V3 input from the voltage generator 300 based on a clock signal CKV, a first control signal (hereinafter, referred to as "an STA signal"), and a second control signal (hereinafter, referred to as "an STB signal") received from the timing controller 110, and applies the first to third storage capacitor driving voltages V1 to V3 to storage capacitor lines in the LCD panel 600. In addition, the first to third storage capacitor driving voltages V1 to V3 have voltage levels in the order of V1, V2 and V3 (V1>V2>V3).

Figure 7:
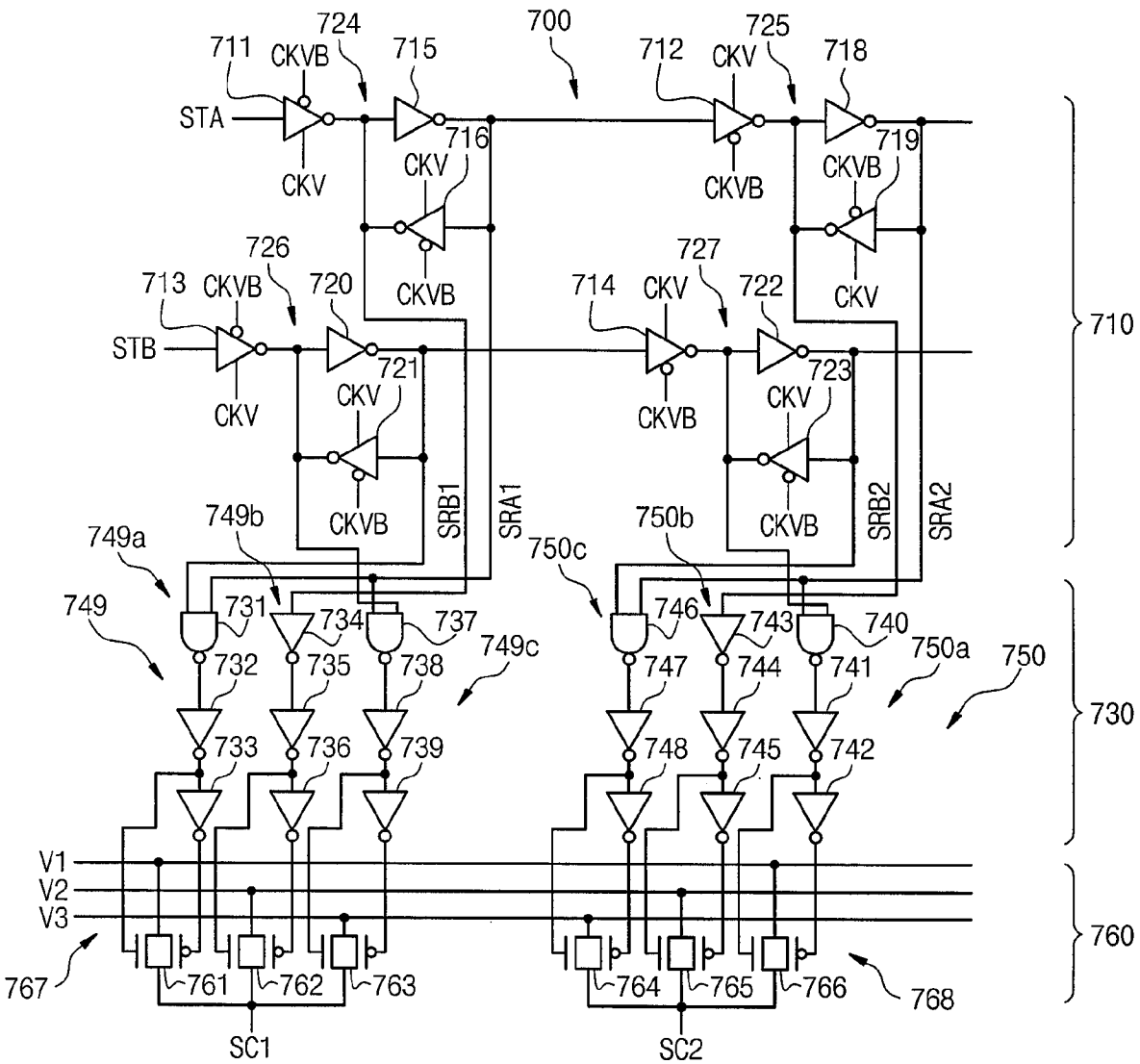
FIG. 7 is a circuit diagram showing a storage capacitor driver of FIG. 6.

Hereinafter, the circuit structure of the storage capacitor driver 700 will be described with reference to FIG. 7. As shown in FIG. 7, the storage capacitor driver 700 includes a shift register 710, a buffer 730, and a voltage level selector 760. In FIG. 7, only the circuit structure corresponding to first and second storage capacitor lines SC1 and SC2 of the LCD panel 600 is shown. Although not shown in the drawings, the same circuit structure is applicable for other storage capacitor lines SC3, and SCn. The shift register 710 operates based on the clock signal CKV, the STA signal, and the STB signal input from the timing controller 110. The shift register 710 has a first flip-flop 724, which includes clock inverters 711 and 716 and an inverter 715, a second flip-flop 725, which includes clock inverters 712 and 719 and an inverter 718, a third flip-flop 726, which includes clock inverters 713 and 721 and an inverter 720, and a fourth flip-flop 727, which includes clock inverters 714 and 723 and an inverter 722. The first and third flip-flops 724 and 726 correspond to the first storage capacitor line SC1 of the LCD panel 600, and the second and fourth flip-flops 725 and 727 correspond to the second capacitor line SC2 of the LCD panel 600.

The flip-flop 724 operates based on the clock signal CKV and an inverted clock signal CKVB obtained by inverting the clock signal CKV. In addition, after latching the STA signal input from the timing controller 110 during a predetermined time interval, the flip-flop 724 outputs a first output signal (hereinafter, referred to as "an SRA1 signal") to the flip-flop 725 and the buffer 730 and a first inverted output signal (hereinafter, referred to as "an inverted SRA1 signal"), which is obtained by inverting the signal SRA1, to the buffer 730.

The flip-flop 725 operates the clock signal CKV and the inverted clock signal CKVB. In addition, after latching the STA1 signal input from the flip-flop 724 during a predetermined time interval, the flip-flop 724 outputs a second output signal (hereinafter, referred to as "an SRA2 signal") to a flip-flop (not shown), which is provided at a next stage of the flip-flop 725, and the buffer 730, and outputs a second inverted output signal (hereinafter, referred to as "an inverted SRA 2 signal"), which is obtained by inverting the SRA2 signal, to the buffer 730.

The flip-flop 726 operates based on the clock signal CKV and the inverted clock signal CKVB. After latching the STB signal during a predetermined time interval, the flip-flop 726 outputs a third output signal (hereinafter, referred to as "a SRB1 signal") to the flip-flop 727 and the buffer 730, and outputs a third inverted output signal (hereinafter, referred to as "an inverted SRB1 signal"), which is obtained by inverting the SRB1 signal, to the buffer 730.

The flip-flop 727 operates based on the clock signal CKV and the inverted clock signal CKVB. After latching the SRB1 signal input from the flip-flop 726 during a predetermined time interval, the flip-flop 727 outputs a fourth output signal (hereinafter, referred to as "an SRB2 signal") to a flip-flop (not shown), which is provided at the next stage of the flip-flop 727, and the buffer 730, and outputs a fourth inverted output signal (hereinafter, referred to as "an inverted SRB2 signal"), which is obtained by inverting the SRB2 signal, to the buffer 730.

The shift register 710 generates the SRA1 signal, the inverted SRA1 signal, the SRA2 signal, the inverted SRA2 signal, the SRB1 signal, the inverted SRB1 signal, the SRB2 signal, and the inverted SRB2 signal based on the STA signal and the STB signal input from the timing controller 110 and outputs sequentially the SRA1 signal, the inverted SRA1 signal, the SRA2 signal, the inverted SRA2 signal, the SRB1 signal, the inverted SRB1 signal, the SRB2 signal, and the inverted SRB2 signal to the buffer 730, through the operations of the first and second flip-flops 724 to 727.

The buffer 730 includes a first buffer 749, which is connected to the output terminals of the flip-flops 724 and 726 and a second buffer 750, which is connected to output terminals of the flip-flops 725 and 727. The first and second buffers 749 and 750 correspond to the first storage capacitor line SC1 and the second storage capacitor line SC2, respectively.

The first buffer 749 includes a V1 selection control circuit 749*a*, a V2 selection control circuit 749*b*, and a V3 selection control circuit 749*c*.

The V1 selection control circuit 749*a* includes a NAND gate 731 and inverters 732 and 733 to control timing of selecting the first storage capacitor driving voltage V1 in the voltage level selector 760 according to the SRA1 signal and the SRB1 signal input from the flip-flops 724 and 726.

The V2 selection control circuit 749*b* includes inverters 734 to 736 to control timing of selecting the second storage capacitor driving voltage V2 in the voltage level selector 760 according to the inverted SRA1 signal input from the flip-flop 724.

The V3 selection control circuit 749*c* includes a NAND gate 737 and inverters 738 and 739 to control timing of selecting the third storage capacitor driving voltage V3 in the voltage level selector 760 according to the SRA1 signal and the inverted SRB1 signal input from the flip-flops 724 and 726.

The second buffer 750 includes a V1 selection control circuit 750*a*, a V2 selection control circuit 750*b*, and a V3 selection control circuit 750*c*.

The V1 selection control circuit 750*a* includes a NAND gate 740 and inverters 741 and 742 to control timing of selecting the first storage capacitor driving voltage V1 in the voltage level selector 760 according to the SRA2 signal and the inverted SRB2 signal input from the flip-flops 725 and 727.

The V2 selection control circuit 750*b* includes inverters 743 to 745 to control timing of selecting the second storage capacitor driving voltage V2 in the voltage level selector 760 according to the inverted SRA2 signal input from the flip-flop 725.

The V3 selection control circuit 750*c* includes a NAND gate 746 and inverters 747 and 748 to control timing of selecting the third storage capacitor driving voltage V3 in the voltage level selector 760 according to the SRA2 signal and the SRB2 signal input from the flip-flops 725 and 727.

The voltage level selector 760 includes a first switch group 767, which is connected to the output terminal of the first buffer 749, and a second switch group 768, which is connected to the output terminal of the second buffer 750. The first and second switching groups 767 and 768 correspond to the first storage capacitor line SC1 and the second storage capacitor line SC2, respectively.

The first switch group 767 includes first, second and third switches 761, 762 and 763. The first switch 761 selects the first storage capacitor driving voltage V1 input from the voltage generator 300 and applies the first storage capacitor driving voltage V1 to the first storage capacitor line SC1, according to the selection timing of the first storage capacitor driving voltage V1 controlled by the V1 selection control circuit 749*a*. The second switch 762 selects the second storage capacitor driving voltage V2 input from the voltage generator 300 and applies the second storage capacitor driving voltage V2 to the first storage capacitor line SC1 according to the selection timing of the second storage capacitor driving voltage V2 controlled by the V2 selection control circuit 749*b*. The third switch 763 selects the third storage capacitor driving voltage V3 input from the voltage generator 300 and applies the third storage capacitor driving voltage V3 input from the voltage generator 300 to the first storage capacitor line SC1, according to the selection timing of the third storage capacitor driving voltage V3 controlled by the V3 selection circuit 749*c*.

The second switch group 768 includes fourth, fifth and sixth switches 764, 765 and 766. The sixth switch 766 selects the first storage capacitor driving voltage V1 input from the voltage generator 300 and applies the first storage capacitor driving voltage V1 to the first storage capacitor line SC1, according to the selection timing of the first storage capacitor driving voltage V1 controlled by the V1 selection control circuit 750*a*. The fifth switch 765 selects the second storage capacitor driving voltage V2 input from the voltage generator 300 and applies the second storage capacitor driving voltage V2 to the storage capacitor line SC1, according to selection timing of the second storage capacitor driving voltage V2 controlled by the V2 selection control circuit 750*b*. The fourth switch 764 selects the third storage capacitor driving voltage V3 input from the voltage generator 300 and applies the third storage capacitor driving voltage V3 to the first storage capacitor line SC1, according to the selection timing of the third storage capacitor driving voltage V3 controlled by the V3 selection control circuit 750*c*.

Figure 8:
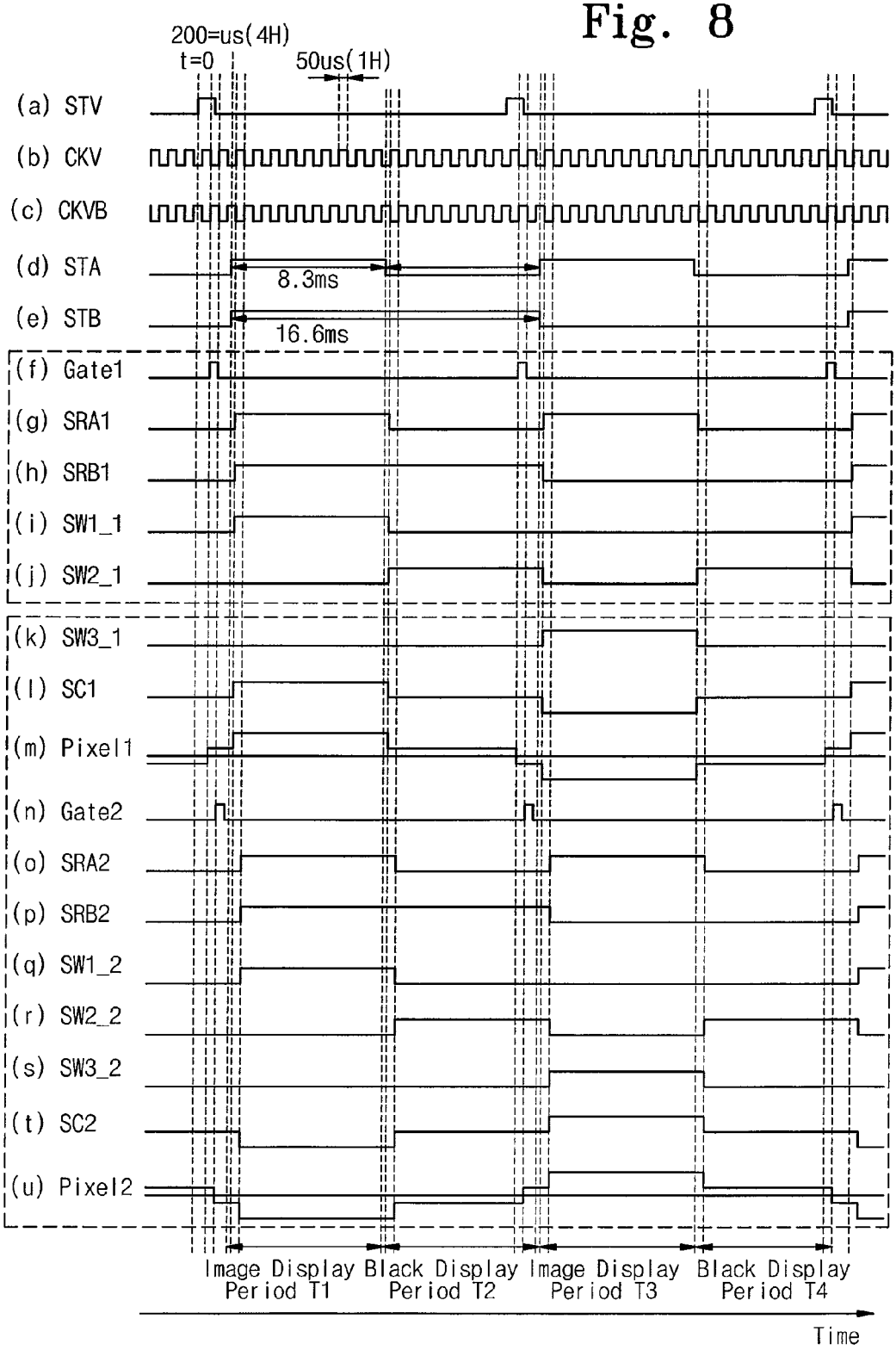
FIG. 8 is a timing diagram showing various signals employed for the liquid crystal display of FIG. 6.

Hereinafter, the operation of the liquid crystal display according to the second exemplary embodiment of the present invention will be described with reference to the timing chart shown in FIG. 8.

FIGS. 8A and 8B show the gate start signal STV, which is input to the gate driver 400, and the clock signal CKV, which is input to the gate driver 400 and the storage capacitor driver 700, respectively. FIGS. 8D to 8F show the STA signal, which is input to the storage capacitor driver 700, the STB signal, which is input to the storage capacitor driver 700, and a scan signal Gate1, which is output to the first gate line from the gate driver 400, respectively. FIGS. 8G to 8I show an SRA1 signal, which is generated from the storage capacitor driver 700, the SRB1 signal, which is generated from the storage capacitor driver 700, and the operation of the first switch 761 in the storage capacitor driver 700, respectively. FIGS. 8J to 8L show the operation of the second switch 762 in the storage capacitor driver 700, the operation of the third switch 763 in the storage capacitor driver 700, and the voltage applied to the first storage capacitor line SC1 by the storage capacitor driver 700, respectively. FIGS. 8M to 8O show the pixel voltage Pixel1 applied to the first pixel in the LCD panel 600, the gate signal Gate2 output to the second gate line from the gate driver 400, and the SRA2 signal generated from the storage capacitor driver 700, respectively. FIGS. 8P to 8S show the SRB2 signal generated from the storage capacitor driver 700, the operation of the fourth switch 765 in the storage capacitor driver 700, and the operation of the fifth switch 766 in the storage capacitor driver 700, respectively. FIGS. 8T and 8U show the voltage applied to the second storage capacitor line SC2 by the storage capacitor driver 700 and the pixel voltage Pixel2 applied to the second pixel in the LCD panel 600, respectively.

As shown in FIG. 8A, the gate start signal STV is output from the timing controller 110 with a time interval of 16.6 ms. In other words, a second pulse of the gate start signal STV starts after the time interval of 16.6 ms lapses from starting timing (t=0) of an initial pulse of the gate start signal STV.

As shown in FIG. 8B, one pulse width of the clock signal CKV corresponds to one horizontal scanning period 1H (in this case, 1H=50 μs). In FIGS. 8D and 8E, the STA signal and the STB signal are used to control the operation of the storage capacitor driver 700.

In FIG. 8F, the scan signal Gate1 is output to the first gate line from the gate driver 400 according to the gate start signal STV. In FIGS. 8G and H, the SRA1 signal and the SRB1 signal are used to set timing of selecting one of the first to third storage capacitor driving voltages V1 to V3 applied to the first storage capacitor line SC1 according to the STA signal and the STB signal. FIG. 8J shows the variation of the first to third storage capacitor driving voltages V1 to V3 applied to the first storage capacitor line SC1 in timing set by the SRA1 signal and the SRB1 signal. FIG. 8L shows the variation of the pixel voltage Pixel1 applied to the first pixel in the LCD panel 600.

The scan signal Gate2 in the FIG. 8N is output to the second gate line from the gate driver 400 according to the gate start signal STV. The SRA2 signal and the SRB2 signal in the FIGS. 8M and 8N are used to set timing of selecting one of the first to third storage capacitor driving voltages V1 to V3 applied to the second storage capacitor line SC2 according to the STA signal and the STB signal.

FIG. 8T shows the variation of the first to third storage capacitor driving voltages V1 to V3 applied to the second storage capacitor line SC2 in timing set by the SRA2 signal and the SRB2 signal. FIG. 8U shows the variation of the pixel voltage Pixel2 applied to the second pixel in the LCD panel 600. Further, both FIGS. 8M and 8U represent the common electrode voltage VCOM, and the level of the common electrode voltage VCOM is constant.

Hereinafter, the detailed operation of the liquid crystal display 20 according to the second embodiment of the present invention will be described with reference to the timing chart shown in FIG. 8.

When the liquid crystal display 20 is powered on, the timing controller 110 inputs the clock signal CKV and the gate start signal STV shown in FIGS. 8A and 8B to the gate driver 400. In addition, the timing controller 110 inputs the clock signal CKV, the STA signal, and the STB signal shown in FIGS. 8A, 8D, and 8E to the storage capacitor driver 700.

Upon receiving the clock signal CKV and the gate start signal STV, the gate driver 400 sequentially outputs the scan signals Gate1 and Gate2 to the first and second gate lines according to the gate start signal STV as shown in FIGS. 8F and 8G. The source driver 200 sequentially applies image voltages according to image signals input from the timing controller 100 to source lines in the LCD panel 600. According to the operations of the gate driver 400 and the source driver 200, the image voltages Pixel1 and Pixel2 according to the image signals are applied to the first and second pixels in the image display period T1 shown in FIGS. 8M and 8N.

Then, upon receiving the clock signal CKV, the STA signal, and the STB signal, the storage capacitor driver 700 selects the first storage capacitor driving voltage V1 by the SRA1 signal and the SRB1 signal to apply the first storage capacitor driving voltage V1 to the storage capacitor line SC1, and selects the first storage capacitor driving voltage V1 by the SRA2 signal and the SRB2 signal and applies the first storage capacitor driving voltage V1 to the second storage capacitor line SC2, in high levels of the STA signal and the STB signal as shown in FIGS. 8D, 8E, 8G, 8H, 80, and 8P. Accordingly, the pixel voltages Pixel1 and Pixel2 according to the image signals are applied to the first and second pixels in the image display period T1 shown in FIGS. 8M and 8U.

Subsequently, in a low level of the STA signal and a high level of the STB signal, the second storage capacitor driving voltage V2 is selected by the inverted SRA1 signal and applied to the first storage capacitor line SC1, and the second storage capacitor driving voltage V2 is selected by the inverted SRA2 and applied to the second storage capacitor line SC2. Accordingly, the pixel voltages Pixel1 and Pixel2 are shifted into the black display potential (VCOM) in the black display period T2 shown in FIGS. 8M and 8U.

Then, after the second pulse of the gate start signal STV starts in FIG. 8A, image display is commenced in the second image display period T3. Since the LCD panel 600 employs the alternating current driving method, in which the polarity of an image signal is inverted in each frame, an image signal obtained by inverting the polarity of the image signal in the first image display period T1 is output from the source driver 200 in the second image display period T3.

In the image display period T3, when the level of the STA signal becomes high and the level of the STB signal becomes low in FIGS. 8D and 8E, the storage capacitor driver 700 selects the third storage capacitor driving voltage V3 based on the SRA1 signal and the inverted SRB1 signal and applies the third storage capacitor driving voltage V3 to the first storage capacitor line SC1, and selects the third storage capacitor driving voltage V3 based on the SRA2 signal and the inverted SRB2 signal and applies the third storage capacitor driving voltage V3 to the second storage capacitor line SC2. Accordingly, as shown in FIGS. 8M and 8U, the pixel voltages Pixel1 and Pixel2 according to image signals are applied to the first and second pixels in the image display period T3.

Subsequently, when the level of the STA signal becomes low and the low level of the STB signal is continuously maintained in FIGS. 8D and 8E, the storage capacitor driver 700 selects the second storage capacitor driving voltage V2 based on the inverted SRA1 signal to apply the second storage capacitor driving voltage V2 to the first storage capacitor line SC1, and selects the second storage capacitor driving voltage V2 based on the inverted SRA2 signal so as to apply the second storage capacitor driving voltage V2 to the second storage capacitor line SC2. Accordingly, as shown in FIGS. 8M and 8U, the pixel voltages Pixel1 and Pixel2 are shifted into the black display potential (VCOM) in the black display period T4.

Then, the above operations are sequentially repeated. The operations for two gate lines and two storage capacitor lines shown in FIG. 8 are also adopted for other gate lines and other storage capacitor lines, not shown. In FIGS. 8M and 8U, the black display period corresponds about 40% of the period, which persists until the next image signals are applied to the first and second pixels.

As described above, in the liquid crystal display 20 according to the second embodiment of the present invention, the storage capacitor driver 700 shifts the level of the voltage applied to the storage capacitor within the predetermined period corresponding to about 20% to about 80% of the period which is lasted until the next image signals are applied to the first and second pixels after image signals are applied thereto, by using three types of storage capacitor driving voltages which are the first and second storage capacitor driving voltages V1 and V2, such that the pixel voltages Pixel1 and Pixel2 are shifted into the black display potential.

Accordingly, the conventional black insertion technique for a large-sized TFT liquid crystal display panel can be adopted for small-sized or middle-sized TFT liquid crystal display panels without increasing the costs of the TFT liquid crystal display panels, so that an after-image phenomenon can be reduced when a moving picture is displayed, and the costs of liquid crystal displays may be reduced. Further, in the liquid crystal display 20 according to the second embodiment of the present invention, since a high voltage is applied by the storage capacitor line, the dynamic range of an image signal can be reduced, and the power consumption of the liquid crystal display 20 may be reduced.

Further, according to the second exemplary embodiment of the present invention, although the black display period is set at about 40% of the period which is lasted until the next image signals are applied to the first and second pixels after image signals are applied thereto, the percentage of the black display period may be changed within the range of about 20% to about 80% of the period which is lasted until the next image signals are applied to the first and second pixels after image signals are applied thereto.

Embodiment 3

Although the black insertion driving is performed within the second half of the period which is lasted until the next image signals are applied to the first and second pixels after image signals are applied thereto according to the first exemplary embodiment of the present invention, the black insertion driving may be performed within the first half of the period which is lasted until the next image signals are applied to the first and second pixels after image signals are applied thereto according to a third exemplary embodiment of the present invention.

The same reference numerals will be assigned to the elements identical to those of FIGS. 1 and 2, and detailed description thereof will be omitted in order to avoid redundancy.

Hereinafter, the operation of a liquid crystal display according to the third embodiment of the present invention will be described with reference to the timing chart shown in FIG. 9.

Figure 9:
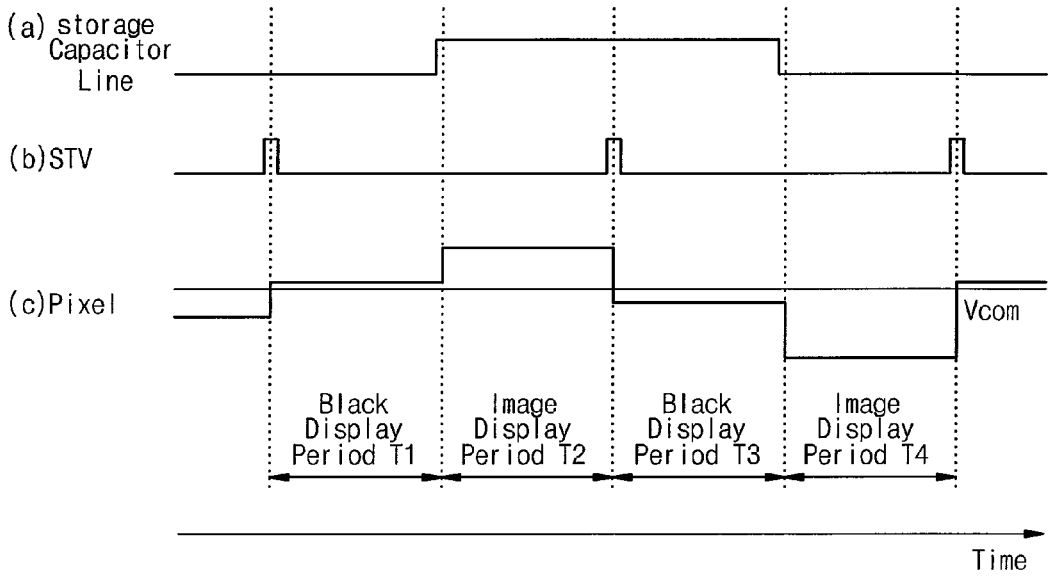
FIG. 9 is a timing diagram showing various signals employed for a liquid crystal display according to a third embodiment of the present invention.

FIGS. 9A to 9C show the voltage applied to a storage capacitor line, a gate start signal STV input to a gate driver 400, and a pixel voltage Pixel1 applied to a pixel in the LCD panel 600, respectively. In addition, a clock signal CKV, an STA signal, an SRA1 signal, and an SRA2 signal are not shown in FIG. 9.

The voltage applied to the storage capacitor line in FIG. 9A is selected from two types of storage capacitor driving voltages, which are first and second storage capacitor driving voltages V1 and V2, by the SRA1 signal and the SRA2 signal generated based on the STA signal in the storage capacitor driver 500.

A gate start signal STV in FIG. 9B is identical to the gate start signal according to the first exemplary embodiment of the present invention. A pixel voltage in FIG. 9C represents the pixel voltage Pixel applied to a pixel of the LCD panel 600. In addition, FIG. 9C shows a common electrode voltage VCOM, and the level of the common electrode voltage VCOM is constant.

First, referring to FIG. 9A, upon receiving the clock signal CKV and the STA signal, the storage capacitor driver 500 selects the first storage capacitor driving voltage V1 to apply the first storage capacitor driving voltage V1 to the storage capacitor line SC. Accordingly, the pixel voltage Pixel in FIG. 9C is shifted into the black display potential (VCOM) in the black display period T1.

Subsequently, referring to FIG. 9A, the storage capacitor driver 500 selects the first storage capacitor driving voltage V1 to apply the first storage capacitor driving voltage V1 to the storage capacitor driving line SC. Accordingly, referring to FIG. 9C, the pixel voltage Pixel according to image signals is applied in the image display period T2.

Then, referring to FIG. 9A, the storage capacitor driver 500 maintains the second storage capacitor driving voltage V2 applied to the storage capacitor line SC. In this case, since the LCD panel 600 employs the alternating current driving scheme, in which the polarity of an image signal is inverted in each frame, an image signal having an inverted polarity is input in the second image display period T3. Accordingly, the pixel voltage Pixel is shifted into the black display potential (VCOM) in the second black display period T3.

Thereafter, referring to FIG. 9A, the storage capacitor driver 500 selects the first storage capacitor driving voltage V1 to apply the first storage capacitor driving voltage V1 to the storage capacitor line SC. Accordingly, the pixel voltage Pixel1 according to an image signal is applied in the black display period T4 shown in FIG. 9C.

Then, the above operations are sequentially repeated. FIG. 9C represents a black display period corresponding to about 50% of the period which is lasted until the next image signals are applied to the first and second pixels after image signals are applied thereto.

As described above, in the liquid crystal display 1 according to the third exemplary embodiment of the present invention, the storage capacitor driver 500 shifts the level of the voltage applied to the storage capacitor within the predetermined period corresponding to about 20% to about 80% of the period which is lasted until the next image signals are applied to the first and second pixels after image signals are applied thereto, by using the first and second storage capacitor driving voltages V1 and V2, such that the pixel voltage Pixel is shifted into the black display potential.

Accordingly, the conventional black insertion technique for a large-sized TFT liquid crystal display panel may be adopted for small-sized or middle-sized TFT liquid crystal display panels without increasing the costs of the TFT liquid crystal display panels, so that an after-image phenomenon may be reduced when a moving picture is displayed, and the costs of liquid crystal displays may be reduced. Further, since an image voltage according to an image signal is applied to a pixel in the image display period, and the image voltage is shifted into the black display potential by the voltage applied to the storage capacitor line in the black display period in the liquid crystal display 1 according to the third exemplary embodiment of the present invention, a gamma characteristic may be easily set.

Further, according to the third exemplary embodiment of the present invention, although the black display period is set at about 50% of the period which is lasted until the next image signals are applied to the first and second pixels after image signals are applied thereto, the percentage of the black display period may be changed in the range of about 20% to about 80% of the period which is lasted until the next image signals are applied to the first and second pixels after image signals are applied thereto.

Embodiment 4

Although the black insertion driving is performed within the second half of the period which is lasted until the next image signals are applied to the first and second pixels after image signals are applied thereto according to the second exemplary embodiment of the present invention, the black insertion driving may be performed within the first half of the period which is lasted until the next image signals are applied to the first and second pixels after image signals are applied thereto according to a fourth exemplary embodiment of the present invention.

The same reference numerals will be assigned to the elements identical to those of FIGS. 6 and 7, and detailed description thereof will be omitted in order to avoid redundancy.

Hereinafter, the operation of a liquid crystal display 1 according to the fourth exemplary embodiment of the present invention will be described with reference to a timing chart shown in FIG. 10.

Figure 10:
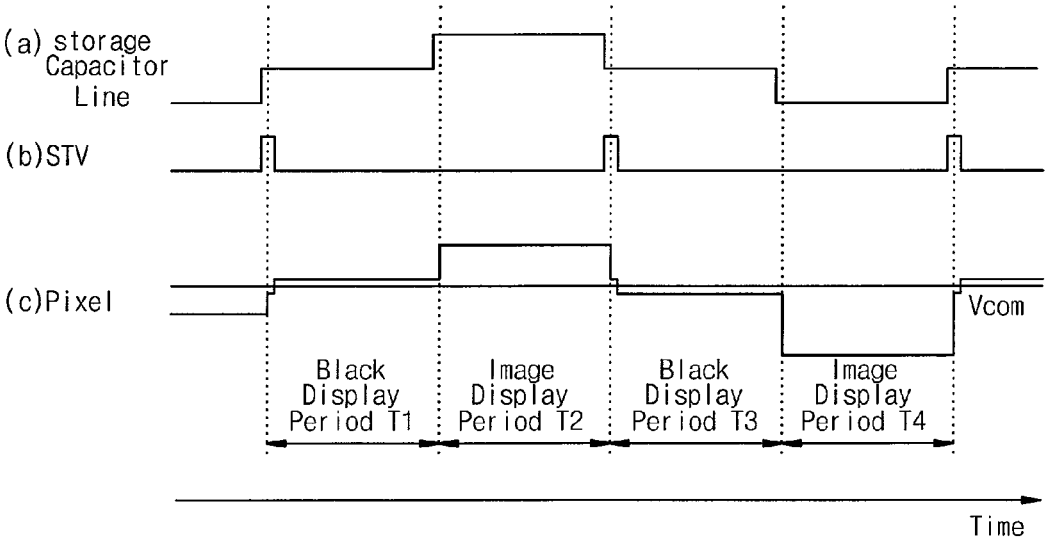
FIG. 10 is a timing diagram showing various signals employed for a liquid crystal display according to a fourth embodiment of the present invention.

FIGS. 10A to 10C show the voltage applied to a storage capacitor line, a gate start signal STV input to a gate driver 400, and a pixel voltage Pixel applied to a pixel in the LCD panel 600, respectively. In addition, a clock signal CKV, an STA signal, an STB signal, an SRA1 signal, an SRB1 signal, an SRA2 signal, and an SRB2 signal are not shown in FIG. 10.

The voltage applied to the storage capacitor line in FIG. 10A is selected from first to third storage capacitor driving voltages V1 to V3 having different levels by the SRA1 signal, the SRA2 signal, the SRB1 signal, and the SRB2 signal generated based on the STA signal and the STB signal in the storage capacitor driver 700.

A gate start signal STV in FIG. 10B is identical to the gate start signal according to the second exemplary embodiment of the present invention. A pixel voltage in FIG. 10C represents the pixel voltage Pixel applied to a pixel in the LCD panel 600. In addition, FIG. 10C shows a common electrode voltage VCOM, and the level of the common electrode voltage VCOM is constant.

First, referring to FIG. 10A, upon receiving the clock signal CKV, the STA signal, and the STB signal, the storage capacitor driver 700 selects the first storage capacitor driving voltage V1 to apply the first storage capacitor driving voltage V1 to the storage capacitor line SC. Accordingly, the pixel voltage Pixel is shifted into the black display potential (VCOM) in the black display period T1 in FIG. 10C.

Subsequently, referring to FIG. 10A, the storage capacitor driver 700 selects the second storage capacitor driving voltage V2 to apply the second storage capacitor driving voltage V2 to the storage capacitor driving line SC. Accordingly, the pixel voltage Pixel according to image signals are applied in the image display period T2 in FIG. 10C.

Then, referring to FIG. 10A, the storage capacitor driver 700 selects the third storage capacitor driving voltage V3 to apply the third storage capacitor driving voltage V3 to the storage capacitor line SC. In this case, since the LCD panel 600 employs the alternating current driving method, in which the polarity of an image signal is inverted in each frame, an image signal having an inverted polarity is input in the second black display period T3. For this reason, the pixel voltage Pixel is shifted into the black display potential (VCOM) in the second black display period T3.

Thereafter, referring to FIG. 10A, the storage capacitor driver 700 selects the first storage capacitor driving voltage V1 to apply the first storage capacitor driving voltage V1 to the storage capacitor line SC. Accordingly, the pixel voltage Pixel according to an image signal is applied in an image display period T4 in FIG. 10C.

Then, the above operations are sequentially repeated. FIG. 10C shows that a black display period corresponds to about 50% of the period which persists after the image signals are applied until the next image signals are applied to the first and second pixels.

As described above, in the liquid crystal display 20 according to the fourth exemplary embodiment of the present invention, the storage capacitor driver 700 shifts the level of the voltage applied to the storage capacitor within the predetermined period corresponding to about 20% to about 80% of the period which is lasted until the next image signals are applied to the first and second pixels after image signals are applied thereto, by using the first to third storage capacitor driving voltages V1 to V3, such that the pixel voltage Pixel is shifted into the black display potential.

Accordingly, the conventional black insertion technique for a large-sized TFT liquid crystal display panel may be adopted for small or middle-sized TFT liquid crystal display panels without increasing the costs of the TFT liquid crystal display panels, so that an after-image phenomenon may be reduced when a moving picture is displayed, and the costs of liquid crystal displays may be reduced. Further, in the liquid crystal display 20 according to the fourth exemplary embodiment of the present invention, since the high third storage driving voltage V3 is applied by the storage capacitor line, the dynamic range of an image signal may be reduced, and the power consumption of the liquid crystal display 20 may be reduced.

Further, according to the fourth exemplary embodiment of the present invention, although the black display period is set at about 50% of the period which is lasted until the next image signals are applied to the first and second pixels after image signals are applied thereto, the percentage of the black display period may be changed in the range of about 20% to about 80% of the period which is lasted until the next image signals are applied to the first and second pixels after the image signals are applied thereto.

According to the liquid crystal display implemented in the exemplary embodiments of the present invention, the black insertion driving method for the large-sized liquid crystal display may be adopted for small-sized or middle-sized TFT liquid crystal display panels without increasing the costs for the TFT liquid crystal display panels, and the after-image phenomenon of a moving picture may be reduced without causing additional costs.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display comprising:

a plurality of pixels including thin film transistors and storage capacitors;

a plurality of gate lines connected to gates of the thin film transistors of the pixels;

a plurality of storage capacitor lines connected to first end portions of the storage capacitors of the pixels;

a gate driver driving the gate lines within a frame period; and a storage capacitor driver changing voltages applied to the storage capacitor lines within the frame period to shift pixel voltages into a black display potential, wherein the storage capacitor driver comprises:

a shift register which receives a control signal and a first and a second clocks, latches the control signal based on the first and the second clocks to output a first output signal, and latches the first output signal based on the first and the second clocks to output a second output signal;

a buffer which receives the first output signal to invert the first output signal n times, and receives the second output signal to invert the second output signal (n+1) times; and a voltage level selector which selects and outputs one of a first and a second storage capacitor driving voltages having different voltage levels in response to the first output signal inverted n times, and selects and outputs one of the first and second storage capacitor driving voltages in response to the second output signal inverted (n+1) times.

2. The liquid crystal display of claim 1, wherein the storage capacitor driver changes levels of the voltages applied to the storage capacitor lines to second levels from first levels within a predetermined period, which persists after image signals are applied to the pixels until next image signals are applied to the pixels and shifts the pixel voltages into the black display potential.

3. The liquid crystal display of claim 1, wherein the storage capacitor driver changes levels of the voltages applied to the storage capacitor lines to second levels from first levels within a first predetermined period corresponding to about 20% to about 80% of a second predetermined period, which persists after image signals are applied thereto until next image signals are applied to the pixels and shifts the pixel voltages into the black display potential.

4. The liquid crystal display of claim 3, wherein the first predetermined period, which persists after the image signals are applied to the pixels until the levels of the voltages applied to the storage capacitor lines are changed to the second levels from the first levels, represents an image display period, and a third predetermined period, which lasts until the next image signals are applied to the pixels after the levels of the voltages applied to the storage capacitor lines are changed into the second levels, represents a black display period.

5. The liquid crystal display of claim 3, wherein, in the storage capacitor driver, the first predetermined period, which persists after the image signals are applied to the pixels until the levels of the voltages applied to the storage capacitor lines are changed to the second levels from the first levels, represents a black display period, and a third predetermined period, which lasts until the next image signals are applied to the pixels after the levels of the voltages applied to the storage capacitor lines are changed into the second levels, represents an image display period.

6. The liquid crystal display of claim 1, wherein the storage capacitor driver drives the storage capacitor lines in a direction identical to a driving direction of the gate lines driven by the gate driver.

7. The liquid crystal display of claim 1, further comprising:

a common electrode disposed in opposition to the pixels; and a common electrode voltage generator supplying a DC voltage to the common electrode within one frame period.

8. The liquid crystal display of claim 1, further comprising a voltage generator which changes the voltages supplied to the storage capacitor lines and the storage capacitor driver.

9. A liquid crystal display comprising:

a plurality of pixels, thin film transistors and storage capacitors;

a plurality of gate lines connected to gates of the thin film transistors of the pixels;

a plurality of storage capacitor lines connected to first end portions of the storage capacitors of the pixels;

a gate driver driving the gate lines within a frame period; and a storage capacitor driver changing levels of voltages applied to the storage capacitor lines into first levels within the frame period to shift voltages applied to the pixels into an image display potential different from the pixel voltages, and changing the levels of the voltages applied to the storage capacitor lines into second levels or third levels to shift pixel voltages applied to the pixels into a black display potential, wherein the storage capacitor driver comprises:

a shift register which receives a first control signal and a first and a second clocks, latches the first control signal based on the first and the second clocks to output a first output signal, and latches the first output signal based on the first and the second clocks to output a second output signal, and the shift register further receives a second control signal and the first and the second clocks, latches the second control signal based on the first and the second clocks to output a third output signal, and latches the third output signal based on the first and the second clocks to output a fourth output signal;

a buffer including a first selection control circuit, which outputs a first to a third selection signals based on the first and the third output signals, and a second selection control circuit, which outputs a fourth to a sixth selection signals based on the second and the fourth output signals; and a voltage level selector including a first switch group, which selects and outputs one of a first to a third storage capacitor driving voltages having different voltage levels in response to the first to the third selection signals, and a second switch group, which selects and outputs one of the first to the third storage capacitor driving voltages in response to the fourth to the sixth selection signals.

10. The liquid crystal display of claim 9, wherein the storage capacitor driver changes levels of the voltages applied to the storage capacitor lines to second levels or third levels from first levels within a period, which persists after image signals are applied thereto until next image signals are applied to the pixels.

11. The liquid crystal display of claim 9, wherein the storage capacitor driver changes levels of the voltages applied to the storage capacitor lines to second levels or third levels from first levels within a first predetermined period corresponding to about 20% and about 80% of a second predetermined period which persists after image signals are applied thereto until next image signals are applied to the pixels.

12. The liquid crystal display of claim 11, wherein the predetermined period, which lasts until the levels of the voltages applied to the storage capacitor lines are changed to the second levels or the third levels from the first levels after the image signals are applied to the pixels, represents an image display period, and a third predetermined period, which lasts until the next image signals are applied to the pixels after the levels of the voltages applied to the storage capacitor lines are changed into the second levels or the third levels, represents a black display period.

13. The liquid crystal display of claim 11, wherein the first predetermined period, which lasts until the levels of the voltages applied to the storage capacitor lines are changed to the second levels or the third levels from the first levels after the image signals are applied to the pixels, represents a black display period, and a third predetermined period, which lasts until the next image signals are applied to the pixels after the levels of the voltages applied to the storage capacitor lines are changed into the second levels or the third levels, represents an image display period.

14. The liquid crystal display of claim 9, wherein the storage capacitor driver drives the storage capacitor lines in the same direction as direction in which the gate lines are driven by the gate driver.

15. The liquid crystal display of claim 9, further comprising:

a common electrode disposed in opposition to the pixels; and a common electrode voltage generator supplying a DC voltage to the common electrode within one frame period.

16. The liquid crystal display of claim 9, further comprising a voltage generator which changes the voltages supplied to the storage capacitor lines and the storage capacitor driver.

* * * * *